United States Patent [19]

Cotey et al.

[11] 4,245,368

[45] Jan. 20, 1981

[54] DUST MOP

[75] Inventors: John Cotey, Pennsauken; Lee Volpe, Collingswood, both of N.J.

[73] Assignee: Quickie Manufacturing Corporation, Cinnaminson, N.J.

[21] Appl. No.: 42,769

[22] Filed: May 29, 1979

[51] Int. Cl.[3] ..... A47L 13/12

[52] U.S. Cl. ..... 15/229 A; 15/229 R; 15/229 AP

[58] Field of Search ..... 15/228, 229 R, 229 B, 15/229 A, 229 AP, 229 AC, 229 AW, 229 BC, 229 BP, 229 BW, 145, 147 R; 403/310, 311, 344

[56] References Cited

U.S. PATENT DOCUMENTS

| | | | |
|---|---|---|---|
| 1,462,794 | 7/1923 | Kumpunen | 15/229 R X |
| 1,604,343 | 10/1926 | Greenwood | 15/229 A |
| 2,722,704 | 11/1955 | Warden | 15/228 X |
| 2,738,533 | 3/1956 | Peterson | 15/229 AP |

*Primary Examiner*—Edward J. McCarthy
*Attorney, Agent, or Firm*—Weiser, Stapler & Spivak

[57] ABSTRACT

A dust mop assembly including an upper mop head which has formed in its lower surface a continuous, peripheral, downwardly open groove. A retainer ring inserts upwardly into the groove and medially secures therewithin a plurality of yarns of suitable size for dusting purposes. In preferred embodiment, a plurality of spaced fingers project downwardly into the groove both to provide adequate clearance for yarn positioning and to secure the retainer ring to the mop head in a manner to cinch and retain the mop yarns therebetween. An elongated socket is integrally formed in the top of the mop head to receive therein a socket portion of an operating handle in a swivel connection.

22 Claims, 9 Drawing Figures

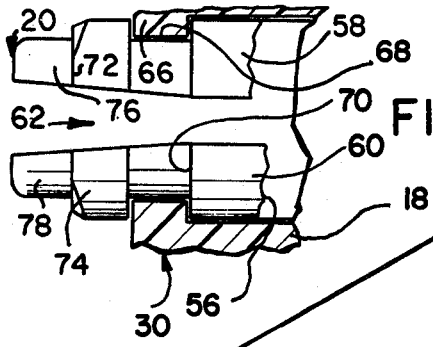
FIG. 9
FIG. 6
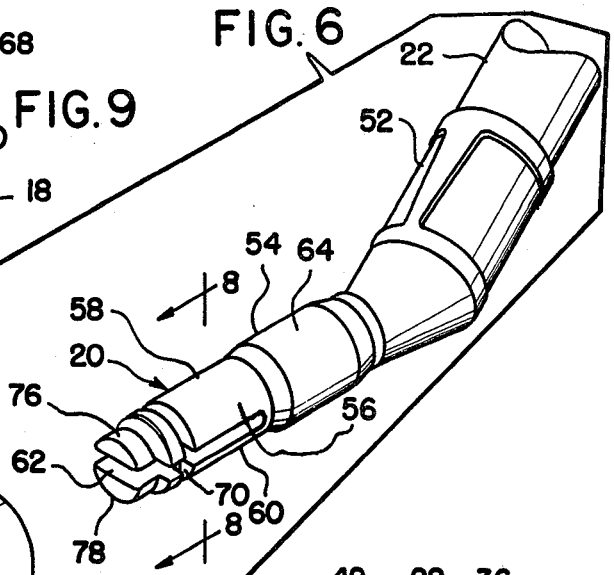
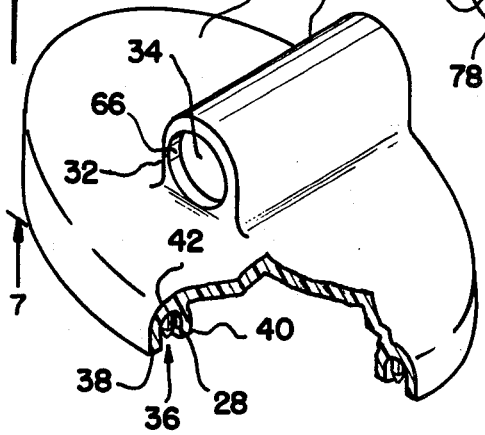
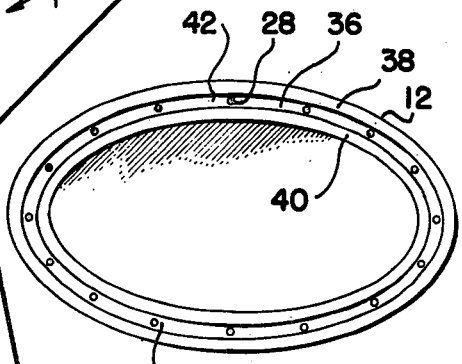
FIG. 7
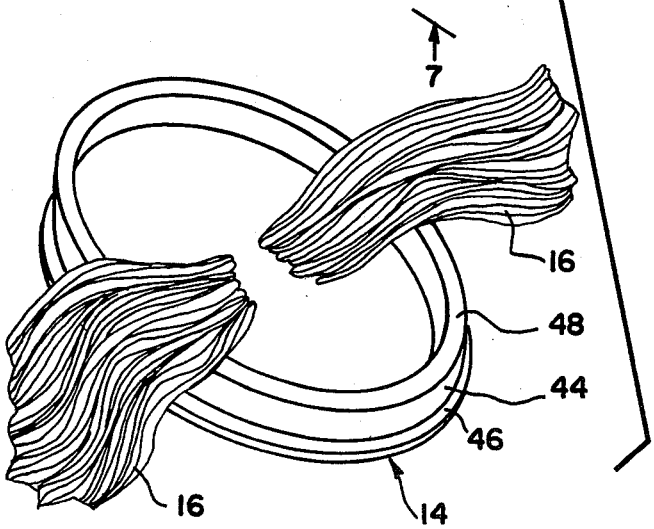
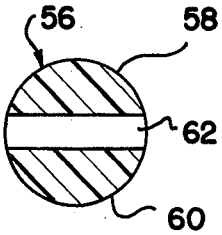
FIG. 8

DUST MOP

BACKGROUND OF THE INVENTION

The present invention relates generally to the field of cleaning utensils, and more particularly, is directed to a dust mop of the type which includes improved yarn retaining construction and improved swivel operation.

Dust mops have long been available for cleaning in and about the home and in commerical and industrial buildings. Such mops characteristically employ a plurality of individual yarns which are interconnected in a manner to be secured to a head for applying over smooth or rough surfaces in a dry condition to thereby gather and retain dust as the mop yarns contact the dust particles. A handle is generally employed in connection with the dust head and it is the usual practice to provide a pivotal connection between the handle and the dust head to facilitate ease in operation.

Most commonly employed dust mop heads utilize a plurality of individual yarns which are first cut to size and then worked as necessary to join the yarns for dust mop purposes. In certain dust mop constructions, the yarns are sewn together on a double needle sewing machine utilizing as many as three rows of stiches and are then formed into a circle for forming the dust mop head. In other prior art constructions, fabrics, plastics, metal rings and the like are secured to the yarn strands by stitching, adhesives and mechanical fastening means to form the yarn strands into an acceptable dust mop unit. The manufacture of the prior art dust mops have included a preponderance of hand operations and the nature of the constructions has inhibited the use of automated fabrication practices.

While such prior art mop constructions have generally performed satisfactorily in service, in view of the time consuming hand operations required in the manufacture of such mops, the cost of manufacture has steadily risen, causing an attendant increase in the price of the finished mop construction to the ultimate consumer. Additionally, the usual pivotal handle connections have proved limited in application and have created certain operating difficulties, especially when attempting to reach areas of restricted access.

SUMMARY OF THE INVENTION

The present invention relates generally to the field of dust mops, and more particularly, is directed to an improved mop head construction which greatly reduces the need for yarn sewing and which facilitates automated, low cost, mop head assembly. The invention additionally is directed to an improved handle to mop head connection which employs a swivel joint to provide increased utility of the dust mop by facilitating access to areas heretofore not easily reached with conventional mop designs.

The dust mop of the present invention includes a mop head which may be of oval, round, or other configuration which is preferably formed of easily molded plastic, such as polypropylene or polyethylene plastic. The mop head is molded or otherwise formed to include a peripheral, endless, downwardly open groove. The peripheral groove is defined by outer and inner walls and by a top which is a part of the body of the mop head. In a preferred embodiment, a plurality of equally spaced fingers project partially downwardly into the groove from from the groove roof to provide clearance for receipt of the mop yarns.

A retainer means comprising a retainer ring of oval, round or other configuration having a retention leg suitable to conform to the configuration of the groove projects upwardly into the mop head groove. The top surface of the retention leg abuts the respective bottoms of the mop head fingers and is secured thereto in a plurality of spaced connections. The dimensions of the retainer ring retention leg and the dimensions of the mop head groove are designed to define respective clearance spaces between the outer surface of the ring retention leg and the outer groove wall and between the inner surface of the ring retention leg and the inner groove wall for yarn positioning purposes. Medial portions of a plurality of individual mop yarns are positioned within the clearance spaces thus provided. The dimensions of the clearance spaces are designed to assure that the yarns are securely cinched between the retainer ring and the mop head groove walls to secure the yarns to the mop head.

The retainer ring is affixed within the mop head groove in an automated fabrication process to provide a connecting means to assure a permanent, secure connection to cinch the mop yarns between the retainer ring construction and the walls which define the groove. Ultrasonic welding techniques can be employed to permanently join the mop head projecting fingers to the top surface of the retainer ring. This permanent interconnection provides an automated, nonseparable, secure junction that functions to increase the speed of manufacture and to prevent unwanted disassociation of the retainer ring from within the mop head groove. If desired, other methods of joining the parts could be employed, such as by utilizing adhesives or mechanical fasteners to affix the retainer ring within the peripheral groove in a manner to secure the yarn strands therebetween.

An upper socket means is integrally molded or otherwise formed in the top of the mop head and defines generally a cylindrical passageway with an unrestricted rear opening and a restricted front opening. A conventional mop handle is connected at one end in angular relationship to a snap swivel connector means, for example at a forty-five degree angle. The handle can be removably affixed to the mop head by inserting the swivel connector through the unrestricted rear opening forwardly until the connector snaps into locked position in the passageway restricted front opening. The swivel connector is rotatable within the socket and, in conjunction with the angularly connected handle, supplies an easy to operate, simple, sturdy and secure swivel connection between the handle and the mop head.

It is therefore an object of the present invention to provide an improved dust mop of the type set forth.

It is another object of the present invention to provide a novel dust mop including a shaped mop head, a peripheral groove means formed in the mop head, and a retainer ring insertable and lockable within the peripheral means to secure a plurality of dust mop yarns therebetween in a permanent interconnection.

It is another object of the present invention to provide a novel dust mop comprising a plastic mop head, the mop head being configured to form a peripheral, downwardly open groove, a separate plastic retainer ring of configuration to upwardly fit into the groove and connecting means to secure the retainer ring to the mop head in a manner to permanently cinch a plurality of mop yarns therebetween.

It is another object of the present invention to provide a novel dust mop comprising a plastic mop head molded to include a downwardly open peripheral groove, a plurality of integral projecting fingers projecting downwardly into the groove and a separate retaining ring upwardly insertable into the groove and lockable therein to secure a plurality of yarns within the groove and to prevent disassociation of the yarns from the mop head.

It is another object of the present invention to provide a novel dust mop including a polypropylene plastic mop head defining a downwardly open groove, a polypropylene plastic retainer ring positioned within the groove and finger means in the groove whereby the retainer ring can be ultrasonically welded to the projecting fingers to form a permanent bond between the parts.

It is another object of the present invention to provide a novel dust mop including a plastic mop head, a plastic socket integrally molded in the mop head and extending upwardly therefrom, a handle including a snap swivel connector positioned in angular relationship, thereto, the swivel connector being insertable into the mop head socket and being lockable therewithin to provide a swivel interconnection between the handle and the mop head.

It is another object of the present invention to provide a novel dust mop that is simple in design, inexpensive in manufacture and trouble free when in use.

It is another object of the present invention to provide an automated method of dust mop assembly whereby hand operations required to retain the individual dust yarn strands can be minimized.

It is another object of the present invention to provide an automated method of fabricating a dust mop of the type including a plastic mop head, a plastic retaining ring and a plurality of dust gathering yarns which includes ultrasonically welding the plastic parts together to cinch the yarns therebetween.

It is another object of the present invention to provide a novel dust mop construction including a mop head formed with groove means to receive portions of yarns therein, a retainer means positioned within the groove means to secure the portions of the yarns and connecting means to permanently interconnect the mop head and the retainer means.

Other objects and a fuller understanding of the invention will be had by referring to the following description and claims of a preferred embodiment, taken in conjunction with the accompanying drawings, wherein like reference characters refer to similar parts throughout the several views and in which;

BRIEF DESCRIPTION OF THE DRAWINGS

FIG. 6 is an exploded, perspective view of the dust mop, with the head partially broken away to disclose interior construction features.

FIG. 7 is a bottom plan view of the mop head looking from line 7—7 of FIG. 6 in the direction of the arrows.

FIG. 8 is an enlarged cross sectional view taken along line 8—8 of FIG. 6, looking in the direction of the arrows.

FIG. 9 is an enlarged, partial, cross sectional view showing the snap lock construction at the swivel and socket connection.

DESCRIPTION OF THE PREFERRED EMBODIMENT OF THE INVENTION

Figure 1:
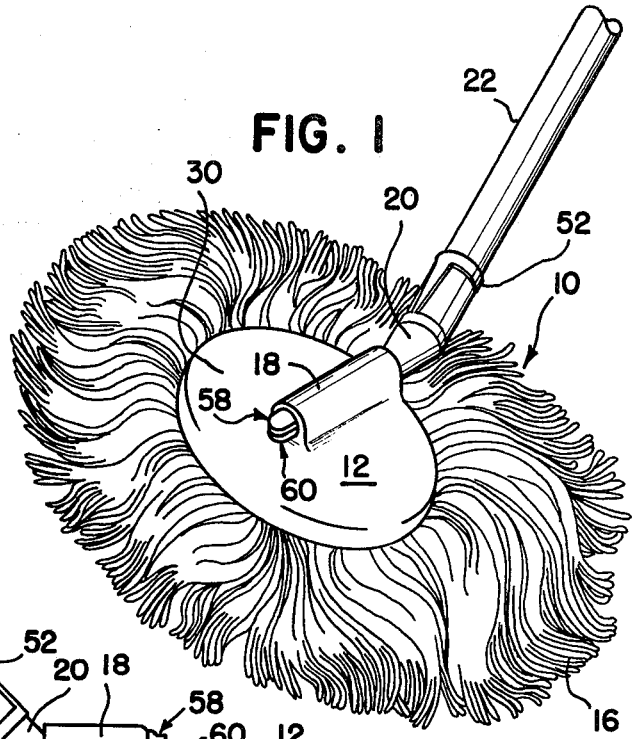
FIG. 1 is a perspective view of a dust mop constructed in accordance with the teachings of the present invention.

Although specific terms are used in the following description for the sake of clarity, these terms are intended to refer only to the particular structure of the invention selected for illustration in the drawings, and are not intended to define or limit the scope of the invention.

Figure 2:
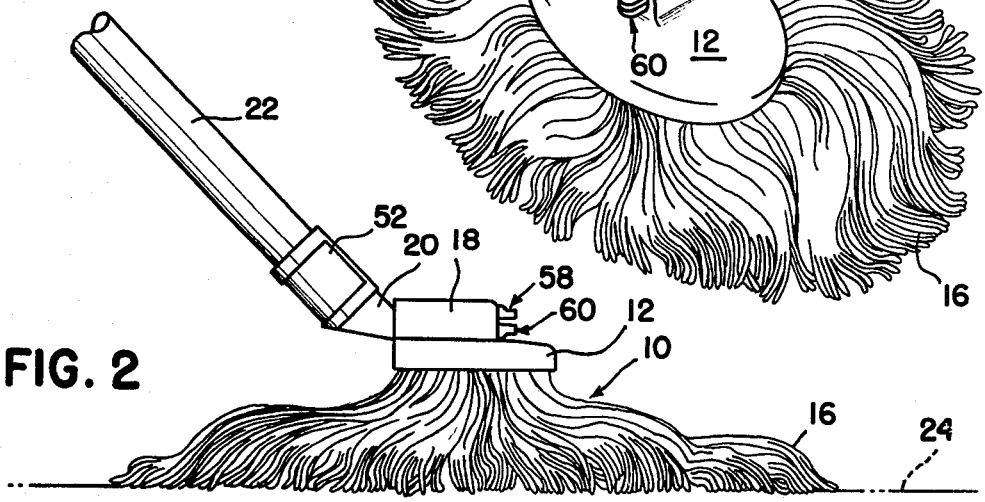
FIG. 2 is a side elevational view of the dust mop of FIG. 1 showing the position of the handle and swivel when the mop is applied to a floor.
Figure 3:
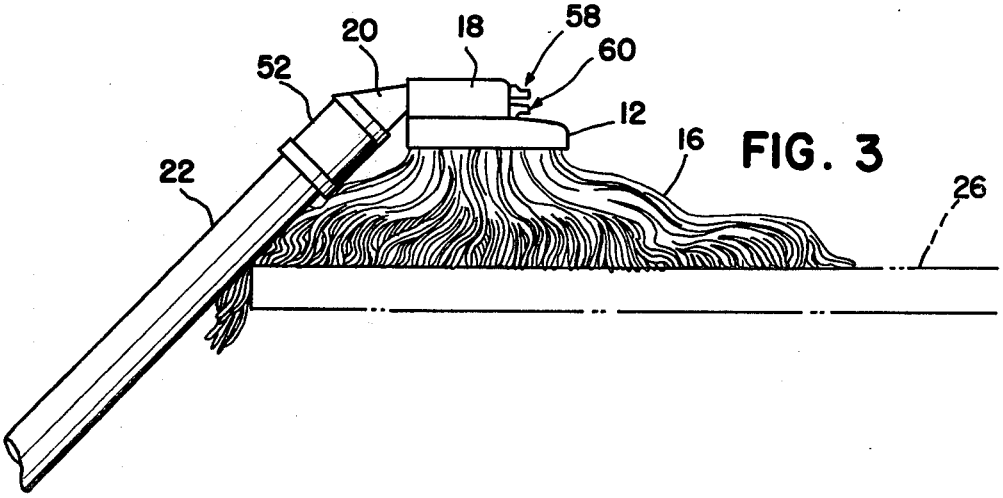
FIG. 3 is a view similar to FIG. 2 showing the position of the mop swivel and handle when the dust mop is applied to an overhead surface.

Referring now to the drawings, there is shown in FIGS. 1, 2 and 3 a dust mop generally designated 10 which comprises a mop head 12 which may be of oval, round or other configuration and which preferably is molded of a plastic material, such as polypropylene plastic or polyethylene plastic to desired configuration as hereinafter more fully discussed. A plurality of dust gathering yarns 16 of conventional type are secured to the mop head 12 in an automatic or semi-automatic assembly as hereinafter more fully set forth. The mop head 12 is upwardly formed to provide a socket means 18. Preferably, the socket 18 and mop head 12 are integral in construction and are molded or otherwise produced in a substantially simultaneous fabrication process. A mop handle 22 of conventional, elongated configuration is stapled, glued or otherwise affixed to a swivel connector 20 to provide a connector means that is angularly offset from the longitudinal axis of the handle 22. The swivel connector 20 is a snap fit within the socket 18 and is rotatable therewithin to facilitate a universal dusting action, for example when dusting a horizontal lower surface 24 such as a floor as shown in FIG. 2 or a horizontal or other elevated surface 26, such as the top of the cabinet as illustrated in FIG. 3.

Figure 5:
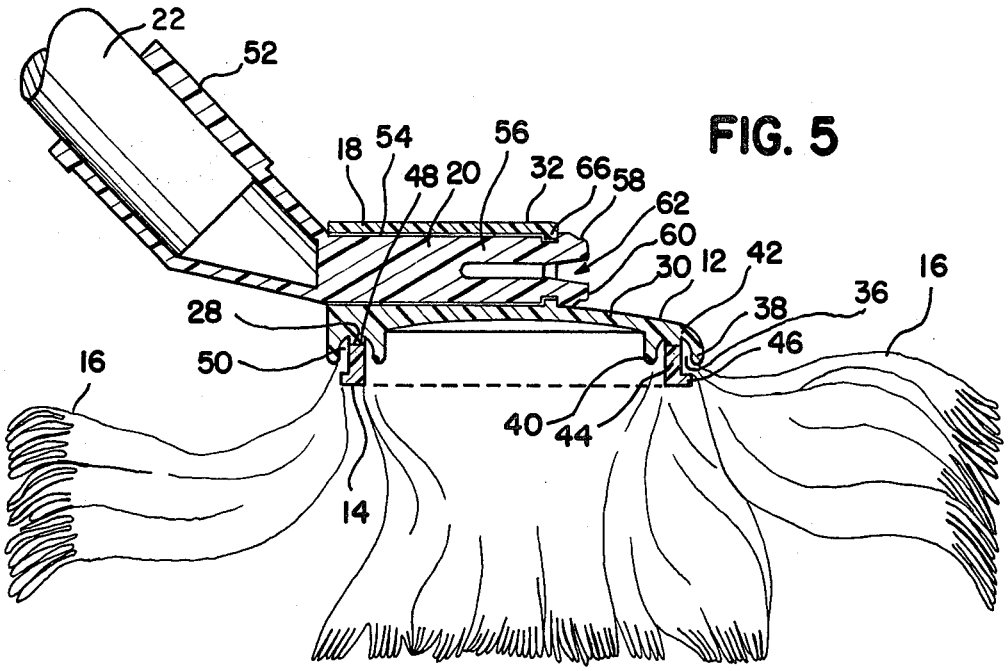
FIG. 5 is a cross sectional view, on reduced scale, taken along line 5—5 of FIG. 4, looking in the direction of the arrows.
Figure 4:
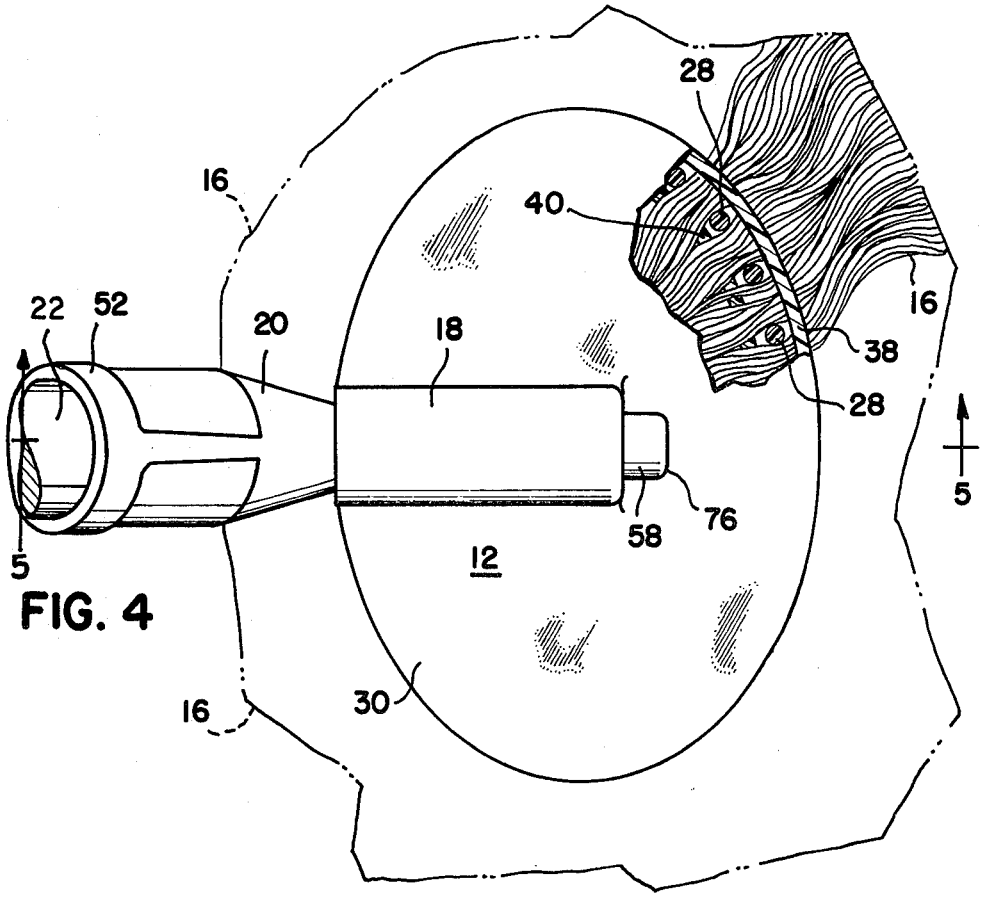
FIG. 4 is an enlarged, partial, top plan view of the dust mop, partially broken away to expose interior construction features.

As best seen in FIGS. 4, 5, 6 and 7, the mop head 12 is molded or otherwise formed to provide an upper, generally planar or dished, sturdy body 30. The socket 18 is preferably integrally simultaneously molded with the mop head 12 and extends upwardly from the top surface of the body 30. As best seen in FIGS. 5 and 6, the socket 18 comprises generally cylindrical sidewalls 32 which define a hollow cylindrical interior space 34 for receipt of the swivel connector means 20 therewithin.

The mop head body 30 is formed to provide a downwardly open, peripheral groove 36, which groove is defined between an outer integral depending peripheral wall 38 and an inner, depending, integral peripheral wall 40. As best seen in FIGS. 4, 5, 6 and 7, a plurality of equally spaced projections or fingers 28 depend downwardly partially into the groove 36 from the groove roof 42 for retainer ring spacing purposes as hereinafter more fully described. Preferably, the projections 28 are integrally formed with the mop head 12 and are simultaneously molded therewith out of polypropylene plastic or polyethylene plastic material in known manner.

Referring now to FIGS. 5 and 6, a retainer means or ring 14 is illustrated of configuration suitable to insert upwardly into the mop head groove 36 for yarn retention. The retainer ring 14 is generally "L" shaped in cross section and comprises a vertical retention leg 44 and an integral generally horizontally disposed locking leg 46. The top surface 48 of the retainer ring 14 is generally planar in configuration and is formed to upwardly contact the plurality of depending, spaced, projecting fingers 28. The top surface 48 of the retainer ring 14 is secured in a permanent manner to the various projections 28 to space the retainer ring construction 14 downwardly from the groove roof 42, outwardly from the groove inner wall 40 and inwardly from the groove outerwall 38 to thus provide a peripheral clearance space between the retainer ring 14 and the mop body construction elements which define the peripheral groove 36. The clearance space is provided to facilitate placing respective medial portions of the mop yarns 16 therewithin to permit locking the yarns 16 between the retainer ring construction 14 and the mop head 12 within the peripheral groove 36 thereof when the device is assembled. The peripheral clearance space 50 between the retention leg 44 of the retainer ring 14 and the walls 38, 40 and roof 42 of the groove 36 is less than the thickness of the yarns 16 to thereby cinch the yarns between the retainer ring 14 and the mop head 16 when the parts are assembled.

In the embodiment illustrated, in the interest of automating the assembly of the parts to as great a degree as possible, it is contemplated that the spaced projections 28 will be ultrasonically welded, by using known techniques, or otherwise secured in a permanent manner, to the planar top surface 48 of the retainer ring retention leg 44. The spaces defined between adjacent projections 28 facilitate placing the medial portions of the yarns 16 between the projections 28 to thereby allow both interconnection of the parts as well as to provide sufficient space for placement of the medial portions of the yarns therewithin prior to assembly.

While it is anticipated that ultrasonic welding of the spaced projections 28 to the retainer ring 14 will preferably be employed, it should be noted that other means of interconnecting the retainer ring 14 and the mop head 12 could be provided and fall within the meaning and intent of this invention. For example, spaced projections 28 should be provided in the mop head in a manner similar to that illustrated and a plurality of corresponding, registered, depending, spaced sockets (not shown) could be formed in the retention leg 44 to receive the respective projections 28 therewithin. Then by employing known adhesives, the parts could be strongly interconnected to cinch the yarns 16 within the mop head groove 36. Also, a retention ring 14 could be secured within the mop head groove 36 to retain the medial portions of yarns therebetween by utilizing mechanical fasteners (not illustrated) such as wires, screws, fasteners, etc. (all not shown) in a manner to permanently bind the parts together to cinch the yarns 16 therebetween.

Referring now to FIGS. 5, 6, 8, 9 and 10, the swivel connector means 20 will now be described. As best seen in FIG. 6, the swivel connector 20 comprises a rearwardly open socket portion 52 of suitable size to receive therein the forward end of a conventional mop handle 22 in a secure manner. The handle 22 may be secured within the socket 52 by friction, by adhesives (not shown) by a staple or other mechanical fastener (not shown) or other conventional manner. If desired, a spline arrangement or locking key construction (both not shown) could also be employed to secure the handle 22.

The socket portion 52 of the swivel connector 20 terminates forwardly in a integral connector barrel 52 which is angularly offset therefrom. In the preferred embodiment, the longitudinal axis of the barrel portion 54 is offset from the longitudinal axis of the socket portion 52 at an angle of forty-five degrees thereby angularly inclining the handle 22 at an angle of forty-five degrees from the generally planar mop body 30 for ease in operation of the dust mop upon full assembly.

The barrel portion 54 of the swivel connector 20 is sized to insert forwardly into the socket 18 and to be retained therein in a secure, rotatable interconnection. To facilitate interconnecting and disconnecting the swivel connector 20 from the mop head 12, preferably the barrel portion 54 includes a split connector end 56 wherein connecting ends 58, 60 are defined from each other by a groove or slot 62.

As best seen in FIG. 9, the socket 18 terminates forwardly in an inward peripheral lip 66 for removably locking the swivel connector 20 to associate the handle 22 with the mop head 12. The connector halves 58, 60 are respectively provided with corresponding grooves 68, 70 of suitable size and configuration to receive therein the peripheral lip 66 in a snap connection. The grooves 68, 70 are respectively defined between the rearward portions of the connector halves 58, 60 and the forward collars 72, 74 for snap-in lock purposes. Each of the upper and lower connector halves 58, 60 terminates forwardly in a grasping projection 76, 78 which are of suitable size and strength to permit grasping the projections 76, 78 and squeezing them together when connecting or disconnecting the swivel 20 within the socket 18. The bearing section 64 of the connector 20 is a rolling fit within the socket 18 to facilitate easy rotation of the mop head 12 relative to the handle 22 for mop application purposes.

Although the present invention has been described with reference to the particular embodiment herein set forth, it is understood that the present disclosure has been only by way of example and that numerous changes in the details of construction may be resorted to without departing from the spirit and scope of the invention. Thus, the scope of the invention should nto be limited by the foregoing specification, but rather only by the scope of the claims appended thereto.

What is claimed is:

1. In a dust mop construction of the type including a plurality of dust gathering yarns, the combination of a mop head, the mop head comprising groove means to receive therein portions of the yarns, the groove means comprising a downwardly open groove, the groove being peripherally positioned about the mop head;

retainer means adapted to position within the groove means to secure the said portions of the yarns; and connecting means to interconnect the mop head and the retainer means with the portions of the yarns secured therebetween.

2. The dust mop of claim 1 and a socket means affixed to the mop head, the socket means being adapted to connect a handle to the mop head in a movable manner.

3. The dust mop of claim 2 and swivel connector means removably connected to the socket means to secure a handle to the mop head in a swivel connection.

4. The dust mop of claim 1 wherein the groove is endless.

5. The dust mop of claim 2 wherein the socket means comprises generally cylindrical sidewalls which define a hollow cylindrical interior space.

6. The dust mop of claim 3 wherein the swivel connector means comprises a socket portion and a barrel portion, the barrel portion being angularly offset from the socket portion to position a handle in angular relationship to the mop head.

7. In a dust mop construction of the type including a plurality of dust gathering yarns, the combination of a mop head, the mop head comprising groove means to receive therein portions of the yarns;

retainer means adapted to position within the groove means to secure the said portions of the yarns, the retainer means comprising a retainer ring having a retainer leg, the retainer leg being adapted to secure portions of the yarns to the mop head; and connecting means to interconnect the mop head and the retainer means with the portions of the yarns secured therebetween.

8. In a dust mop construction of the type including a plurality of dust gathering yarns, the combination of a mop head, the mop head comprising groove means to receive therein portions of the yarns;

retainer means adapted to position within the groove means to secure the said portions of the yarns; and connecting means to interconnect the mop head and the retainer means with the portions of the yarns secured therebetween, the connecting means comprising fingers projecting into the groove means.

9. The dust mop of claim 8 wherein the fingers are integral with the mop head.

10. The dust mop of claim 9 wherein the fingers are positioned within the groove means to define yarn receiving spaces therebetween.

11. The dust mop of claim 10 wherein the fingers are secured to the retainer means and are adapted to space the retrainer means from the mop head within the groove means.

12. The dust mop of claim 5 wherein the sidewalls define an unrestricted rear opening for receipt of a handle connector therein.

13. The dust mop of claim 12 wherein the sidewalls terminate forwardly in an inwardly projecting lip.

14. The dust mop of claim 6 wherein the barrel portion is circular in cross section and wherein the barrel portion is adapted to roll within the socket means.

15. The dust mop of claim 6 wherein the socket portion comprises split connector ends, the connector ends being endwardly separated by a groove.

16. The dust mop of claim 15 wherein at least one of the ends is provided with a collar, the collar defining a locking groove, the locking groove being adapted to releasably receive a portion of the socket means therein to secure the swivel connector means to the socket means.

17. The dust mop of claim 15 wherein at least one of the ends is provided with a forward projection, the forward projection projecting forwardly out of the socket means to facilitate grasping the forward projection to remove the swivel connector from the socket means.

18. The method of fabricating a dust mop of the type including a mop head having an outer periphery comprising the steps of placing medial portions of a plurality of yarns about the periphery of the mop head;

urging a retainer means against the medial portions of the yarns and pressing the yarn portions against the mop head; and connecting securely the retainer means to the mop head and cinching the medial portions of the yarns therebetween.

19. The method of claim 18 wherein the connecting is at spaced intervals.

20. The method of claim 19 wherein the connecting employs portions of the mop head and portions of the retainer means for securing the parts together.

21. The method of claim 19 wherein the connecting is by ultrasonic welding.

22. The method of claim 18 and bending the medial yarn portions while pressing them against the mop head.

* * * * *